United States Patent [19]

Rowzee et al.

[11] Patent Number: 5,046,427

[45] Date of Patent: Sep. 10, 1991

[54] DIFFERENTIAL PRESSURE SENSOR

[75] Inventors: Charles A. Rowzee, Burtonsville; John D. Sherman, Silver Spring, both of Md.

[73] Assignee: The United States of America as represented by the Secretary of the Navy, Washington, D.C.

[21] Appl. No.: 445,329

[22] Filed: Nov. 1, 1982

[51] Int. Cl.[5] ..... F42B 22/04

[52] U.S. Cl. ..... 102/418

[58] Field of Search ..... 102/416, 417, 418, 419, 102/420

[56] References Cited

U.S. PATENT DOCUMENTS 2,892,404 6/1959 Glennon et al. ..... 102/418

3,927,615 12/1975 Keithley ..... 102/418

*Primary Examiner*—Charles T. Jordan

*Attorney, Agent, or Firm*—Kenneth E. Walden

[57] ABSTRACT

A pressure sensor for use with a sea mine for detecting the presence of a passing vessel by sensing a change in ambient water pressure caused by the Bernoulli effect relating to hydrodynamic flow induced by the vessel's motion. The sensor emits a responsive signal which can be used alone, or with signals from other influence sensors (acoustic and magnetic), to determine when the sea mine shoud be exploded. The sensor provides for equal sensitivity independent of the ambient pressure of the water at various depths at which sea mines may be planted, and employs electrical filters to eliminate noise.

8 Claims, 3 Drawing Sheets

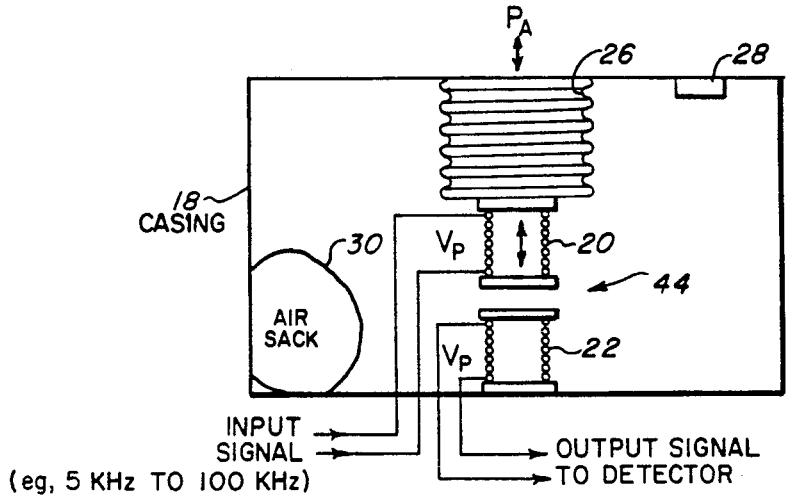
FIG. 3a
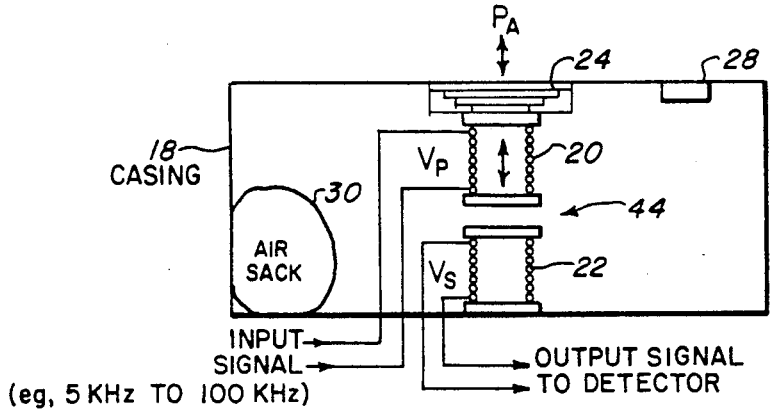
FIG. 3
$$e_A \sim P_A$$
$$\Delta e_o \sim \frac{\Delta P}{P_A^2}$$
$$\Delta e_o' = e_A^2 \, \Delta_{e_o} \sim \Delta P$$
FIG. 4
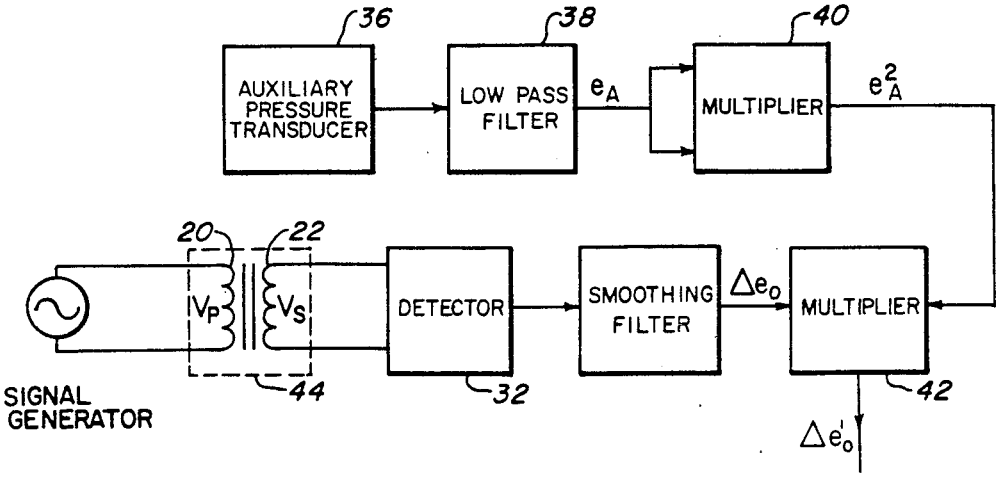

DIFFERENTIAL PRESSURE SENSOR

BACKGROUND OF THE INVENTION

Sea mines over a long history have assumed many forms, but they are generally categorized as "controlled" mines, actuated from a remote source when a target is detected, or "automatic" mines, which are planted unattended and left to their own devices to detonate upon proximity of a target. Automatic mines are subdivided into "contact" mines, which require the target to actually strike it, and "influence" mines, which merely require the target to draw sufficiently near for initiating detonation.

While crude, contact mines have been effective for many years. Still, when navies of the world sought to increase mine capability, they turned to influence mines which may be detonated by some situation causing a local disturbance or change.

Many types of "single" influence sensors for sea mines have been developed, one type of which is the magnetic sensor. It detects a vessel upon its perturbations of the earth's magnetic field. Transducers employing the principle of piezoelectricity to emit electrical signals responsive to acoustic waves have been used in influence sensors for sea mines. More recently, geophones have been employed in bottom mines to sense vibrations of a passing vessel. This type may involve permanent magnetics and a moving coil to generate a signal.

Pressure sensors for mines were developed by Germany in World War II. Their "oyster" mine used this type of sensor. It employed the principle of an air-filled rubber bag which at depth expanded upon exposure to lower water pressures, caused by water flow created by a ship passing in the vicinity, to allow electrical contacts to complete a circuit to explode the mine. While quite sensitive, this type sensor had a limited working depth. This is one of the shortcomings addressed in the present invention.

It is now recognized that the influence signature of a target is a complex phenomenon involving a number of influences including pressure, magnetics, acoustics, and others. Thus, to provide the maximum amount of discriminatory capability for a mine, several sensor output signals must be processed together to yield a single composite "fire" signal based on the simultaneous interrelated behavior of all. Furthermore, with plural influence inputs required to fire a mine there is less chance of inadvertent firing or interference by opposing forces to destroy the mine or render it harmless.

The sensor is adapted to automatically equalize itself to the pressure at ambient depth in which the sea mine is laid, thereby allowing use in practically any waters. It detects variations in pressure from ambient with equal sensitivity regardless of its initial ambient pressure (water depth). It further filters out transient pressure variations which are usually of higher frequency or shorter duration then those caused by a passing ship.

SUMMARY OF THE INVENTION

This invention relates to a pressure sensor for use in association with a sea mine for detecting the presence of passing vessels. It senses changes in ambient water pressure due to hydrodynamic flow caused by a vessel's motion through water and emits an output signal which, usually in conjunction with output signals of other influence sensors (e.g., acoustic and magnetic), establishes when the sea mine should be exploded. The sensor is adapted to allow fluctuations in ambient sea water pressure, such as caused by a passing vessel, to move one coil relative to another coil to effect the extent of electrical coupling between them. An input signal to one coil, for example, is coupled into the other coil and an output signal proportional to variations in water pressure is emitted at a magnitude depending upon the closeness of the coils. Unfortunately, the sensitivity of this type sensor also decreases as the square of the ambient water pressure, or as the square of its depth in water.

Therefore, to compensate for the inverse dependance of the output on the square of ambient water pressure, a second, less sensitive, sensor whose output depends only on the ambient pressure is used. The second output signal is squared and multiplied by the first output signal to render an output dependent on pressure variations and independent of ambient pressure. Accordingly, the sensor provides an output signal whose sensitivity is independent of the depth in water at which it operates. In other words, it has the same sensitivity to variations from ambient pressure regardless of the depth of water in which the sea mine is dropped.

It is, therefore, an object of this invention to provide a sensor for emitting a signal in response to variations in water pressures caused by hydrodynamic flow resulting from a vessel passing through water.

It is a further object of the invention to provide a sensor which, in response to variations in water pressure, emits signals which, in association with other influence produced signals, are processed to detonate a sea mine at appropriate timing.

It is a still further object of the invention to provide a sensor for use with a sea mine for emitting a signal in response to variations in water pressure caused by a passing vessel and including means of generating a second signal by, the ambient background pressure which, when squared and multiplied with the first signal, render it insensitive to pressure at initial water depths at which sea mines may be laid.

It is yet a further object of the invention to-provide a sensor for use in a sea mine which is adapted to emit a responsive signal caused by the hydrodynamic flow of water due to a vessel's motion, yet filter out usually higher frequencies produced by transient ambient pressure changes.

Other objects of the invention will become apparent to one skilled in the art upon reading the specification and claims against the drawings forming a part hereof.

BRIEF DESCRIPTION OF THE DRAWINGS

FIG. 3 is a cross sectional representation of the casing and movable coils of FIG. 2.

FIG. 3*a* is a cross sectional representation similar to FIG. 3 but illustrating an alternate form.

FIG. 4 is a diagram representing the signal processing apparatus according to the present invention for providing an emitted signal $\Delta e'_o$ which is not effected by pressure at the various water depths at which the sea mine may be planted.

DESCRIPTION OF THE PREFERRED EMBODIMENTS

Figure 1:
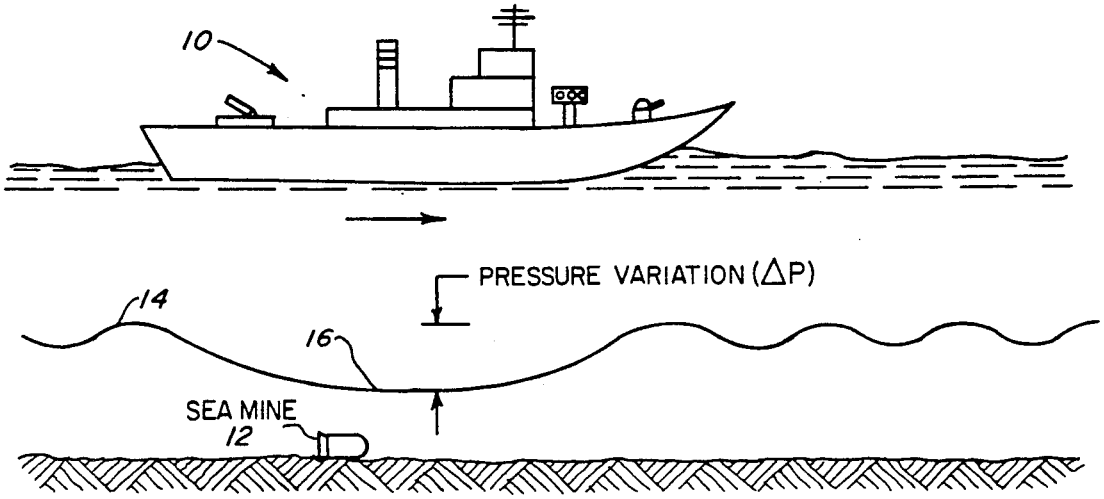
FIG. 1 illustrates a ship passing over a bottom sea mine with a differential pressure representation.

Referring now to the drawings, there is illustrated in FIG. 1 a ship 10 passing through water in which a sea mine 12 has been planted on the bottom at some depth to define an ambient pressure ($P_A$). This pressure is generally represented by the line 14 upon which pressure variations ($\Delta P$) are impressed. These variations results from numerous phenonema. The varieties of shorter frequencies illustrated on line 14 likely result from surface waves. Tide level would raise or lower line 14 as a whole but would not induce or cause the short pressure variations. The longer length depression 16 in line 14 is induced by hydrodynamic flow in water caused by the passing ship.

The present invention relates to a sensor adapted to sense the pressure variations ($\Delta P$) from ambient pressure ($P_A$) at sea mine depths and emit a responsive signal for further processing. There is illustrated in the FIG. 2 perspective drawing a casing 18 housing a transformer consisting of a primary coil 20 and a secondary coil 22. The secondary coil may be fixedly mounted to the casing and the primary coil mounted to a movable member or means such as a diaphragm 24 or bellows 26 (FIG. 3a) in one wall of the casing. The primary coil, receiving an input signal, moves with the diaphragm or bellows as the external water pressure changes to effect a distance change therebetween to couple more or less of its input signal ($V_P$) into the secondary coil which, in turn, emits a responsive output signal ($V_S$).

Figure 2:
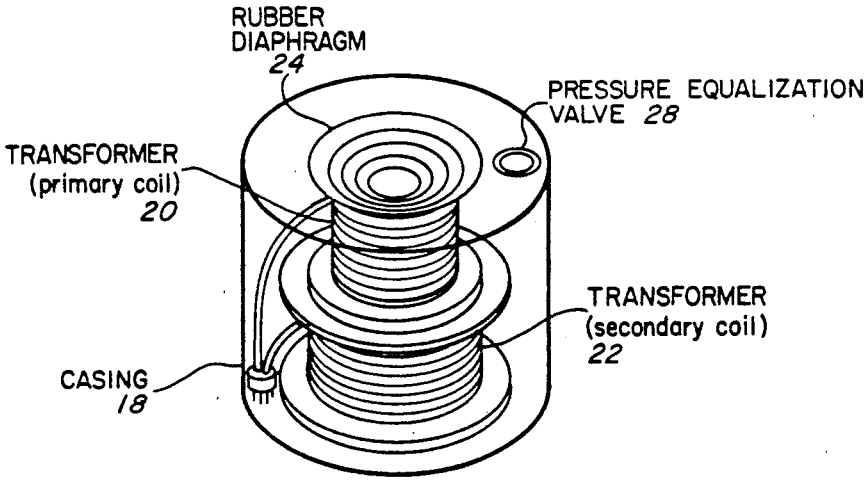
FIG. 2 is a perspective view of a casing and diaphragm enclosing a pair of movable coils for coupling an electrical signal from one to the other to define part of the pressure sensor.

FIG. 3 is a cross sectional representation of the sensor illustrated in FIG. 2 and shows a secondary coil 22 fixed with respect to one wall of casing 18 and a primary coil 20 adapted for movement with diaphragm 24 which is exposed to outside water pressure. An alternate embodiment of the casing and sensor is illustrated in FIG. 3a where a bellows 26 replaces diaphragm 24. All other features of the arrangement remain the same as in FIG. 3. There is provided in one wall of casing 18 (FIGS. 3 and 3a) a valve 28 for allowing sea water to enter the casing upon planting of the sea mine in water whereby pressure inside the casing equalizes with pressure at ambient depth. This feature positions diaphragm 24, and, therefore, the primary coil 20 at about the same distance from the secondary coil 22 for all background pressures. Valve 28 may be held open by a soluble tablet or a solenoid (neither illustrated), each of which permits the valve to permanently close only after the casing has had an opportunity to fill with sea water. Entry of the water into casing 18, in addition to positioning the coils at an initial fixed distance, compresses all trapped in the chamber or in a hermetically sealed air sack or bladder 30 according to the gas law:

$$V_A = \frac{P_o V_o}{P_A},$$

where $V_A$ is the volume of trapped air and $P_A$ is the pressure at ambient depth, while $V_o$ and $P_o$ are the volume and pressure of air at the water surface. For example, assuming $P_o$ is 14.7 psi, the pressure at 40 feet will be 32.2 psi and the air volume will be 0.45 of the surface air volume. At 200 feet depth the pressure will be 102.8 psi and the air volume will be 0.143 of the surface air volume.

The dynamic behavior of the pressure sensor can be analyzed by assuming that pressure signals, deviations from $P_A$, occur on the outside of the chamber. These signals cause the diaphragm or bellows to move since the trapped air will be either compressed (due to $+\Delta P$) or allowed to expand (due to $-\Delta P$). The force to move the diaphragm bellows (spring force) is assumed negligible. When P is applied, since the trapped air must still obey the gas law, we have $$(V_A + \Delta V) = \frac{V_A P_A}{(P_A + \Delta P)} = \frac{P_o V_o}{(P_A + \Delta P)} \quad (2)$$

where $\Delta V$ is the change in air volume. This change in air volume must be equal to the change in the volume displaced by the lengthening of the bellows or diaphragm which is given by:

$$\Delta V = D\Delta L \quad (3)$$

where D is the bellows or diaphragm diameter and AL is the change in its length. Substituting (3) into (2) and solving for $\Delta L$ we obtain:

$$\Delta L = \frac{P_o V_o}{D} \frac{\Delta P}{P_A^2 + P_A \Delta P} \quad (4)$$

Since $P_A^2 >> P_A \Delta P$, this reduces to:

$$\Delta L = \frac{P_o V_o}{D} \frac{\Delta P}{P_A^2} \quad (5)$$

Thus, the sensitivity of this pressure sensor decreases as the square of ambient pressure or, equivalently, as the square of the depth. To illustrate this effect, the difference in sensitivity at 40 feet depth compared to 200 feet depth is a factor of 10. This nonlinearity will be addressed below. It should be noted that in order to always have the same initial volume of air, Vo, it is necessary not to allow any air to escape from the chamber of casing 18 when water enters as the mine goes to depth. Equivalently, when an air bladder or sack 30 is used as a controlled volume, there may be provided valving (not illustrated) so that no additional trapped air will be present.

The relationship between the output voltage $V_S$ of the secondary coil and the separation distance is not easily calculated. However, for small variations around a quiscent point, $V_S/\Delta L$ can be assumed constant.

Two approaches can be taken to account for the nonlinearity of the sensor. The pressure sensor has an output which is predicted to vary inversely with the square of the ambient pressure as:

$$\Delta e_o = K\Delta L = \frac{K P_o V_o}{D} \frac{\Delta P}{P_A^2} \quad (6)$$

One way to compensate for this dependence is by use of the system shown in FIG. 4. The system utilizes a second or auxiliary pressure transducer 36 which produces an output proportional to $P_A$.

$$e_A = K' P_A \quad (7)$$

This small transducer will not by itself be sensitive enough to resolve ΔP and will be lowpass filtered with a very low cutoff frequency to reduce noise. Its output is squared and multiplied by $\Delta e_o$ yielding:

$$\Delta e_o' = \Delta e_o\, e_A^2 = \frac{K\, Po\, Vo}{D}\, \frac{\Delta P}{P_A^2}\, K'^2 P_A^2 = \frac{KK'^2 Po\, Vo}{D}\, \Delta P, \quad (8)$$

therefore $\Delta e'_o \sim \Delta P$ which is independent of the ambient pressure. This approach yields a satisfactory response.

An alternate approach to compensate for the nonlinearity is to allow an AGC or adaptive threshold in the electronics to be governed by the RMS value of the signal from the sensor. Since the reduced sensitivity at increased depth effects both the target signature as well as the noise, the overall system functions satisfactory to detect targets that exceed the background by a desired amount.

Referring once again to the drawings, there is disclosed in FIG. 4 a diagram of the arrangement referred to above for rendering the emited signal responsive to variations in water pressure but independent of the water pressure at ambient depth at which the sea mine 12 is laid. A signal generator provides a signal of around 5 to 100 KHz to primary coil 20 located in spaced adjacency with secondary coil 22. The primary coil is adaptive to be moved relative to the secondary coil by a pressure change ΔP acting against diaphragm 24 or bellows 26 to effect coupling change between them to emit an output signal which is passed to detector 32 and then through a smoothing filter to provide an output signal $\Delta e_o$, which is affected by the ambient pressure at which the sensor is located according to the formula:

$$\Delta e_o \approx \frac{\Delta P}{P_A^2}.$$

Auxilliary pressure transducer 36, which may be of the piezoelectric type, is exposed to the same ambient pressure as that acting on diaphragm 24 or bellows 26 and also emits a signal. This signal is passed through lowpass filter 38 to provide $e_A$ which is passed to multiplier 40 where it is squared to $e^2_A$. This product is multiplied with the first output signal $\Delta e_o$ to emit a final responsive signal $\Delta e'_o = e^2_A \Delta e_0 \approx \Delta P$, which is responsive only to ΔP and not to the pressure at ambient depth at which the sea mine is laid.

That portion of FIG. 4 which is boxed by dashed lines 44 represents the primary and secondary coils identified generally by the numerals 44 in FIGS. 3 and 3a. While in this disclosure the primary coil has been identified as the moving coil and the secondary coil as fixed, they may be identified the other way around.

Figure 5:
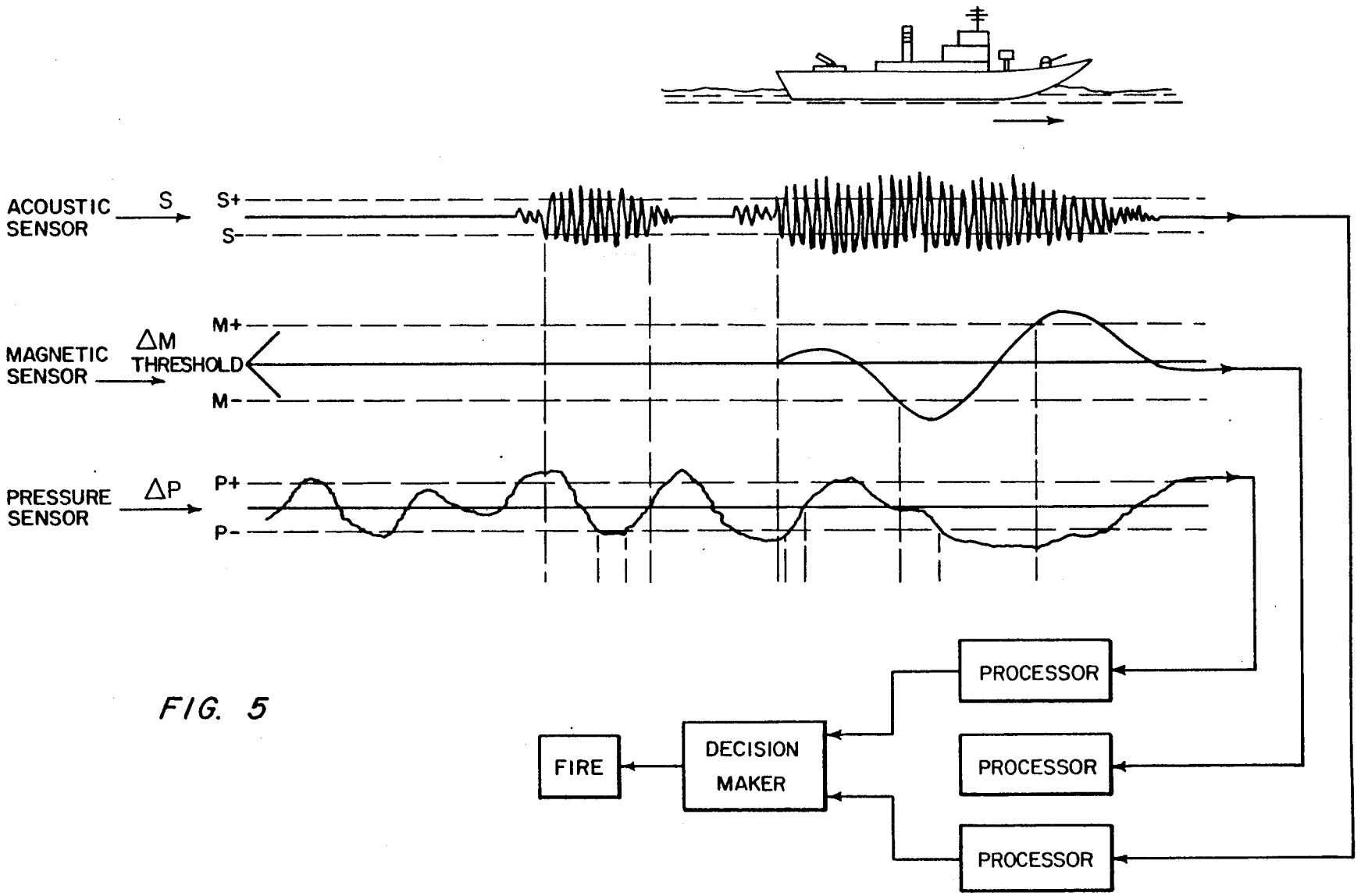
FIG. 5 is a representation of plural influence sensors illustrating their outputs processed for reaching a decision in concert when the sea mine should be detonated.

Emitted responsive signal $\Delta e'_o$ may be used alone as an indication of a low pressure of relatively long duration such as would likely be caused by a passing ship, and this alone be the signal to fire a mine. A more sophisticated arrangement, however, is illustrated in FIG. 5 where the pressure sensor signal is processed in concert with signals attained from an acoustic sensor and from a magnetic sensor to fire a sea mine. In either case, the present sensor provides a responsive output signal, the sensitivity of which is not affected by the depth at which its sea mine has been laid.

The foregoing description relates to preferred embodiments of the invention. It will be understood by those knowledgable in the art that various changes and deviations may be made therein without departing from the spirit of the invention which is limited only by the scope of the claims annexed hereto.

We claim:

1. A pressure sensor for use with a sea mine for sensing variations in water pressure at ambient induced by hydrodynamic flow caused by a passing vessel to emit a responsive signal comprising:

a casing entrapping a volume of gas for pressurization;

means allowing equalization of pressure ($P_A$) within the casing to initially pressurize the trapped air at ambient;

said casing including means adapted for movement (ΔL) against the pressurized gas in response to pressure variations (ΔP) from the ambient according to the formula:

$$\Delta L \sim \frac{\Delta P}{P_A^2}.$$

wherein $P_A$ = pressure at ambient;

means generating a first signal ($\Delta e_o$) responsive to pressure variation from the ambient, the magnitude of which varies according to the formula $$\Delta e_o \sim \frac{\Delta P}{P_A^2};$$

means generating a second signal ($e_A$) responsive to ambient pressure;

means squaring the second signal to ($e_A^2$); and means multiplying the first signal and squared second signal to emit the responsive signal ($\Delta e'_o$) according to the formula:

$$\Delta e_o' = e_o\, \Delta e_A^2 = \frac{K\Delta P}{P_A^2}\, K'^2\, P_A^2$$

whereby $\Delta e'_0 \sim \Delta P$ thereby providing an emitted signal which is independent of the pressure at ambient ($P_A$) resulting from various water depths at which the sea mine may be laid but responsive to pressure variations (ΔP) from the ambient.

2. The invention according to claim 1 wherein the means which allows equalization of pressure includes means holding open valve means in the casing until after the sea mine in which it is used has reached ambient water depth.

3. The invention according to claim 2 including a hermetically sealed flexible bag enclosing the gas entrapped in the casing.

4. The invention according to claim 1 further defined by the means generating the first signal comprising:

a pair of coils in close adjacency with one being mounted for movement with the casing relative to the other coil in response to pressure variations (ΔP) to effect electrical coupling therebetween;

whereby the other coil emits a signal responsive to (ΔP).

5. The invention according to claim 1 further defined by pressure transducer means exposed to the same ambient generating the second signal responsive to ambient pressure.

6. The invention according to claim 5 further defined by the pressure transducer including piezoelectric means.

7. The invention according to claim 5 further defined by a low pass filter in the pressure transducer means output ahead of the multiplier which squares the signal.

8. A method of sensing variation from ambient pressure at water depth at which a sea mine is laid, which variations are caused by hydrodynamic flow due to a passing vessel, and emitting a responsive signal comprising the steps of:

generating a first signal ($\Delta e_o$) which varies according to pressure variations ($\Delta P$) from the ambient pressure ($P_A$) according to the formula:

$$\Delta e_o \sim \frac{\Delta P}{P_A^2};$$

generating a second signal ($e_A$) responsive to the ambient pressure according to the formula $e_A = K'P_A$ and lowpass filtering the second signal to remove noise;

squaring the filtered second signal and multiplying it by the first signal to provide a responsive signal ($\Delta e'_o$) according to the formula:

$$\Delta e_o' = \Delta e_o\, e_A^2 = \frac{\Delta P}{P_A^2} K' P_A^2$$

therefore, $\Delta e'_o \sim \Delta P$, whereby the responsive signal ($\Delta e'_o$) is responsive to pressure variations ($\Delta P$) but is not effected by the pressure of the water ($P_A$) in which the sea mine may be laid.

* * * * *